US006377179B1

(12) United States Patent
Fulton

(10) Patent No.: US 6,377,179 B1
(45) Date of Patent: Apr. 23, 2002

(54) PERSONAL RECOVERY SYSTEM

(76) Inventor: John G. Fulton, 9921 Gordon Rd., Spotsylvania, VA (US) 22553

( * ) Notice: Subject to any disclaimer, the term of this patent is extended or adjusted under 35 U.S.C. 154(b) by 0 days.

(21) Appl. No.: 09/639,939

(22) Filed: Aug. 17, 2000

(51) Int. Cl.[7] ..... G08B 23/00

(52) U.S. Cl. ..... 340/573.1; 340/825.49; 340/539; 340/990; 340/574.1; 348/135; 348/143; 348/158

(58) Field of Search ..... 340/825.49, 539, 340/990, 574.1; 348/135, 143, 158

(56) References Cited

U.S. PATENT DOCUMENTS

| | | | | |
|---|---|---|---|---|
| 4,121,160 A | | 10/1978 | Cataldo | 340/321 |
| 4,736,196 A | | 4/1988 | McMahon et al. | 340/573 |
| 4,819,860 A | | 4/1989 | Hargrove et al. | 228/668 |
| 4,884,132 A | | 11/1989 | Morris et al. | 358/93 |
| 5,014,040 A | | 5/1991 | Weaver et al. | 540/572 |
| 5,043,736 A | | 8/1991 | Darnell et al. | 342/357 |
| 5,045,839 A | | 9/1991 | Ellis et al. | 340/539 |
| 5,153,584 A | | 10/1992 | Engira | 340/870.18 |
| 5,245,314 A | | 9/1993 | Kah, Jr. | 340/539 |
| 5,438,321 A | | 8/1995 | Bernard et al. | 340/573 |
| 5,512,879 A | | 4/1996 | Stokes | 340/573 |
| 5,515,419 A | | 5/1996 | Sheffer | 379/58 |
| 5,519,760 A | | 5/1996 | Borkowski | 379/59 |
| 5,552,772 A | | 9/1996 | Janky et al. | 340/573 |
| 5,617,074 A | | 4/1997 | White | 340/573 |
| 5,621,384 A | | 4/1997 | Crimmins et al. | 340/539 |
| 5,652,570 A | | 7/1997 | Lepkofker | 348/573 |
| 5,712,679 A | | 1/1998 | Coles | 348/158 |
| 5,742,233 A | | 4/1998 | Hoffman et al. | 340/573 |
| 5,742,509 A | | 4/1998 | Goldberg et al. | 364/449.5 |
| 5,742,666 A | | 4/1998 | Alpert | 379/58 |
| 5,940,004 A | | 8/1999 | Fulton | 340/825.49 |
| 6,100,806 A | * | 8/2000 | Gaukel | 340/573.4 |
| 6,122,521 A | | 9/2000 | Wilkinson et al. | 455/457 |

* cited by examiner

*Primary Examiner*—Daryl Pope
(74) *Attorney, Agent, or Firm*—Welsh & Flaxman LLC

(57) ABSTRACT

A personal recovery unit including a transmitter unit carried by a user is disclosed. The transmitter unit includes an accelerometer, safe zone and/or a video unit used to providing desired warning signals.

19 Claims, 5 Drawing Sheets

PERSONAL RECOVERY SYSTEM

BACKGROUND OF THE INVENTION

1. Field of the Invention

The invention relates to a personal recovery system. More particularly, the invention relates to a recovery system that provides automatic warnings at predetermined times.

2. Description of the Prior Art

One of the most difficult jobs any of us may face is responsibility for the well being of another person. Whether the responsibility is that of a parent for his or her child, or a child for his or her elderly parent, responsibility for another person is taken very seriously. This responsibility must, however, be balanced with the independence of the custodial person and the impossible task of always monitoring the whereabouts and status of the child or elderly parent.

Our society has recently found itself facing the rapid escalation in occurrences of human predators preying, typically, on the weak (for example, elderly persons, women, and children). These victims, often faced with abduction intent, are defenseless against more powerful aggressors. If no method of alerting others is available, the outcome can be horrible and often the final incident in their lives. In the end, our society must rely on crude search strategies (that is, police sketches, dogs, lines of people with flashlights) and luck to find the victims. Increasingly, these incidents are occurring in broad daylight in school yards, grocery store parking lots and bus stops. There appears to be no real safe haven anymore.

When children become responsible for their elderly parents, the balance of independence and monitoring becomes difficult, and limited options are available. The elderly parent may move in with the children, however, this is very often not desirable from both the child and the parents' point of view. In the alternative, the elderly parent may move into a retirement home, where support is provided for the parent, or the elderly parent may continue living on his or her own with no ready means of support.

Regardless of the choice, continuously monitoring the whereabouts and medical status of the parent is oftentimes impossible. While a conscious parent may call in the event of an emergency, an unconscious, or otherwise incapable, parent is unable to notify anyone of the emergency assistance he or she may require.

Various monitors are known in the art. However, these monitors fail to fully meet the needs addressed above. In most instances these monitors require the user of the monitor to activate the monitor to transmit a warning signal. Monitors such as these become useless for an abducted child or an unconscious elderly parent.

Other monitors continuously and regularly emit a signal. The continuous and regular transmission of a signal may provide the location of the user, but it fails to provide a status indication of the user.

For example, a monitor worn by an unconscious parent will tell the child that the parent is at home, but the monitor will not tell the child that the parent is unconscious. In addition, these monitors will not tell a child that the parent has fallen, broken some bones and cannot move due to extreme pain. In this case, with the onset of shock, the time it takes for help to be alerted is critical. Similarly, a monitor worn by a child may tell the parent that the child is around the house or on her way home from school, but the monitor will not tell the parent that the child is not in trouble.

As such, a need exists for a personal recovery system which allows a guardian to monitor both the location and the status of an individual, particularly if that individual is mobile. The present invention provides such a system. In addition, there are many other situations in which a user might employ the present system, such as when a user is hiking, boating or otherwise unable to make their status known.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
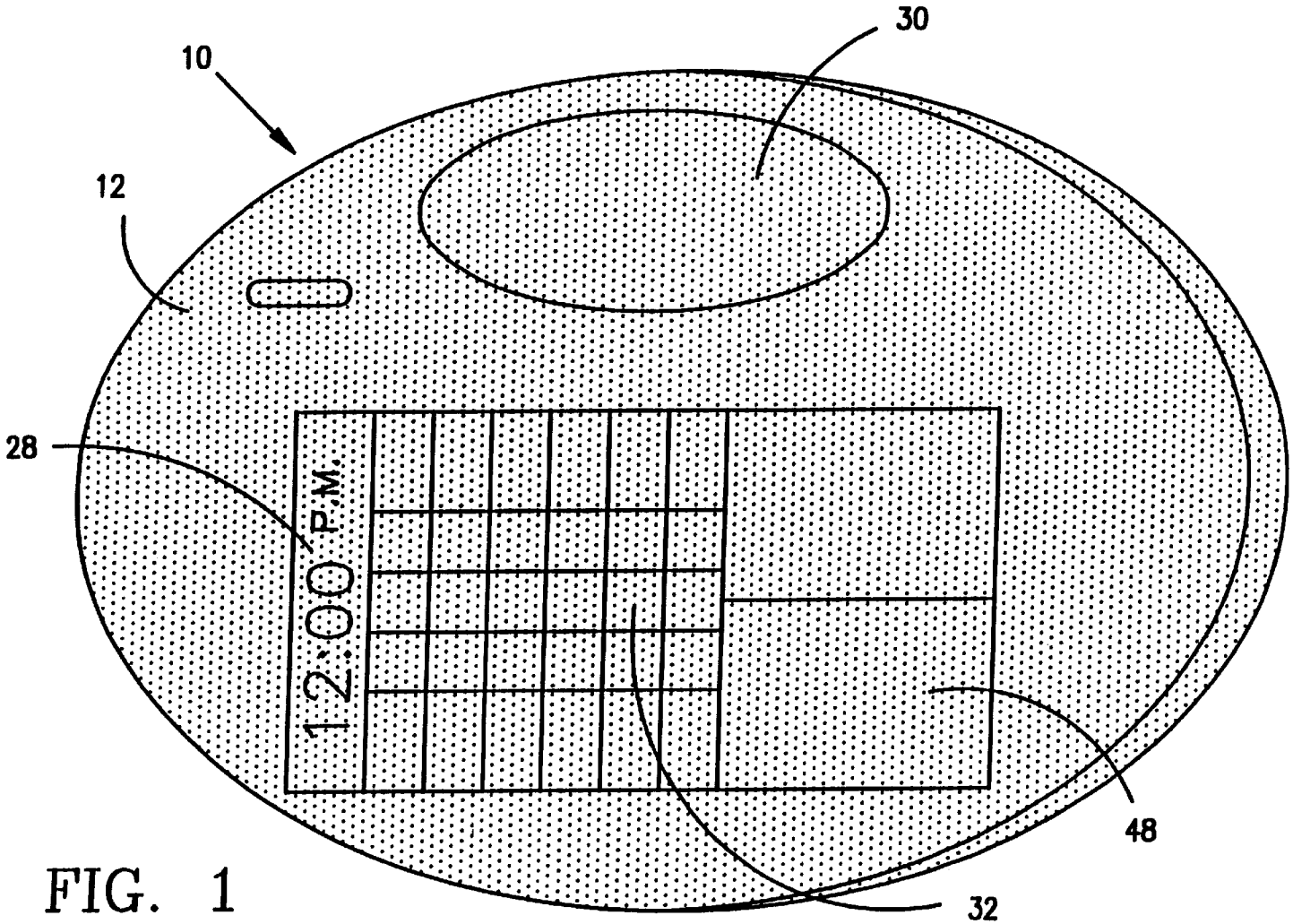
FIG. 1 is a perspective view of the transmitter unit used in accordance with the present personal recovery system.
Figure 3:
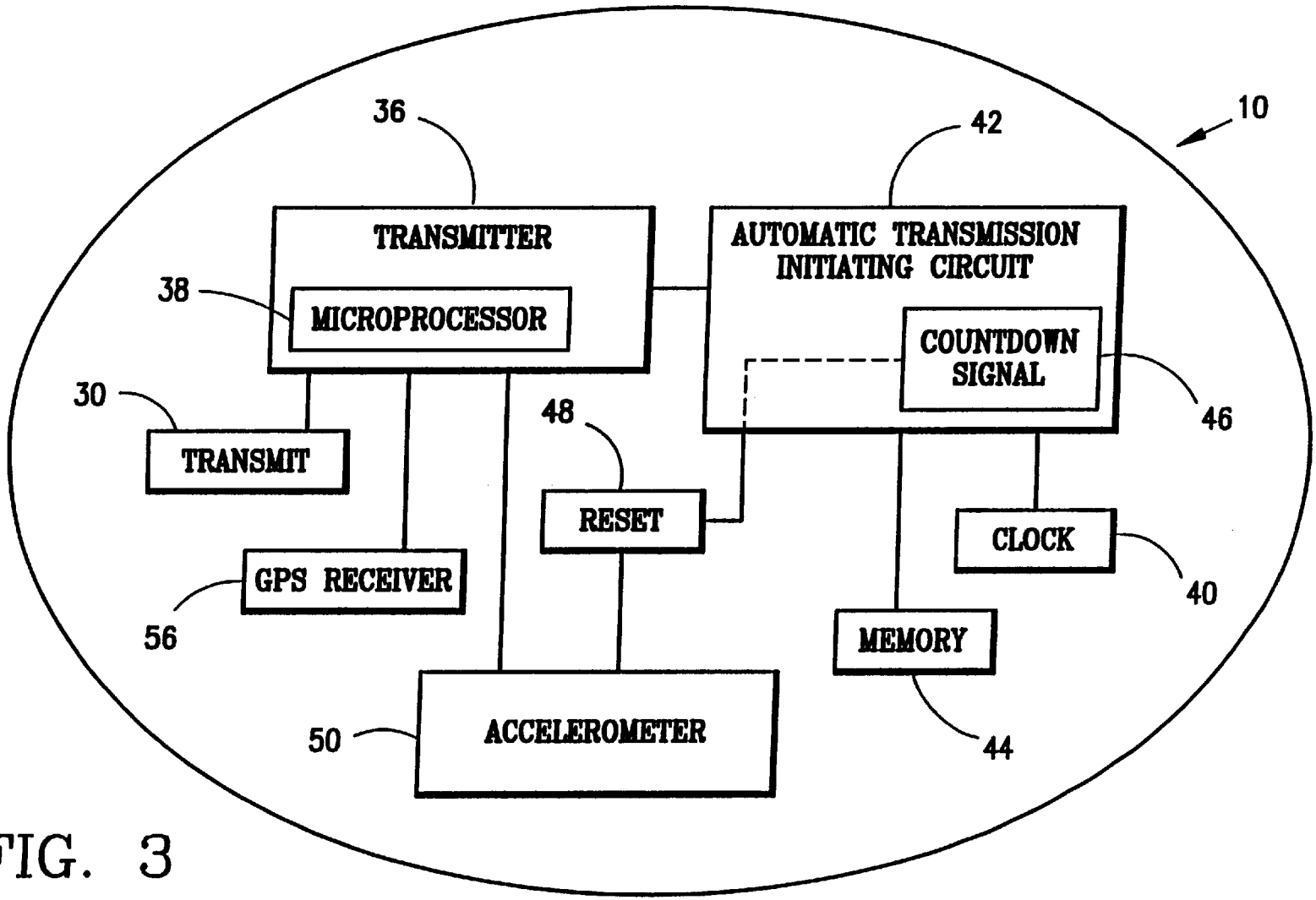
FIG. 3 is a schematic of the circuitry employed in the transmitter unit.

With reference to FIGS. 1 and 3, a transmitter unit 10 of the present personal recovery system 12 is disclosed. The transmitter unit 10 includes a transmitter case 14 housing the working electrical components of the transmitter unit 10. The transmitter case 14 is preferably oval shaped, and is approximately 2¼" long and 1⅜" wide. The oval shape provides a discrete casing which is not easily noticed when the transmitter unit 10 is carried in the pocket of an individual. Having no corners to protrude, a curved domed top and a flat back, the oval shaped transmitter unit 10 slips easily into tight and enclosed areas of clothing without exhibiting an easily observed profile.

Figure 2:
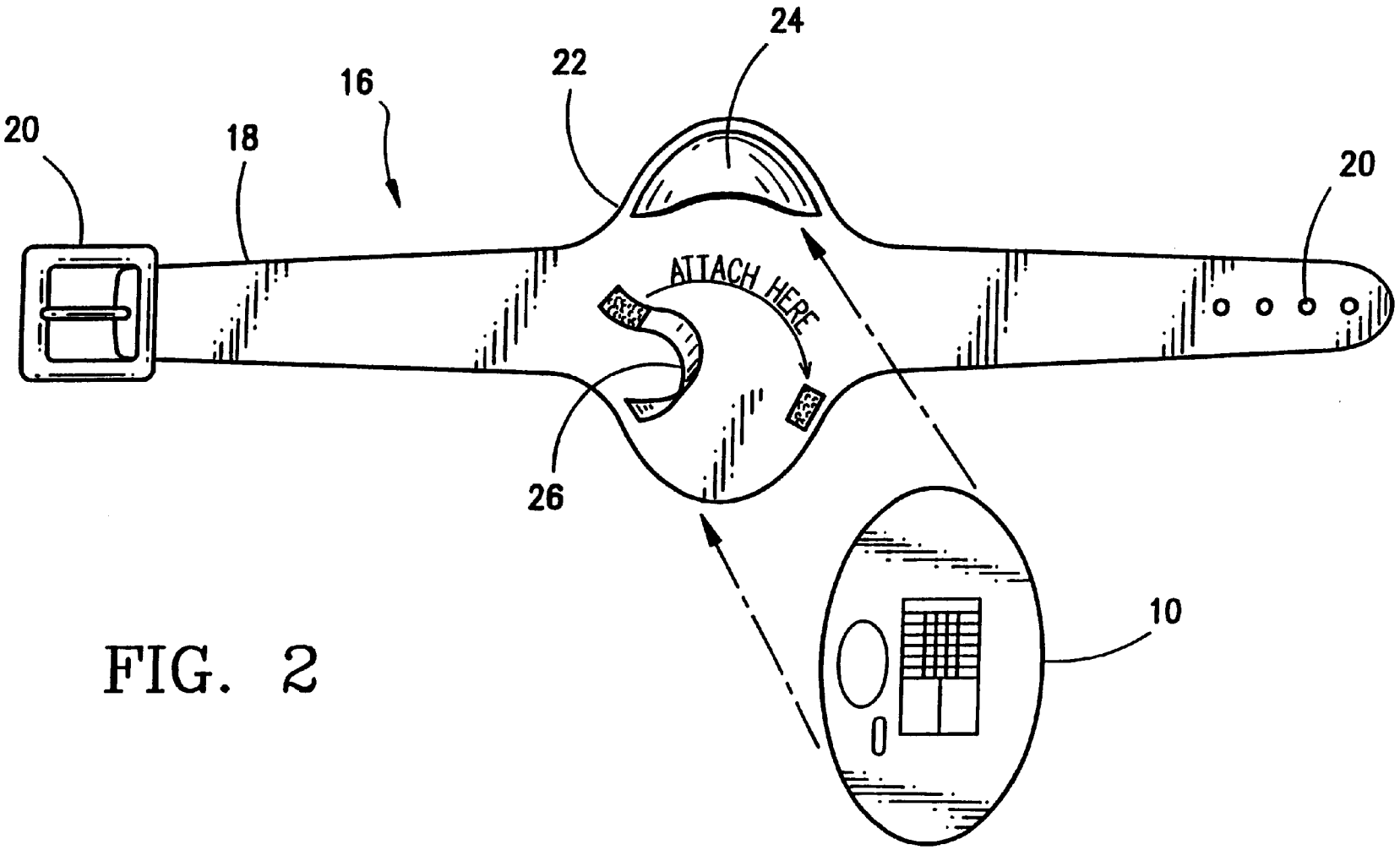
FIG. 2 is perspective view of a carrying case used in conjunction with the present invention.

With reference to FIG. 2, a carrying case 16 is also provided for selectively attaching the transmitter unit 10 to a user's wrist. The carrying case 16 includes a conventional watch wrist band 18 with fastening members 20 at opposite ends and a central support plate 22. The support plate 22 includes a small pocket 24 and a strap 26 for selectively holding the transmitter unit 10 in place.

In use, the oval shape of the transmitter unit 10 permits one curved corner of the transmitter unit 10 to be slipped into the pocket 24 on the carrying case 16, while the opposite corner is strapped down via a VELCRO, hook and loop type connector, strap 26. This allows the digital clock readout 28, the transmit button 30 and the programming buttons 32 of the transmitter unit 10 to remain visible for operator access. In the event the unit must be quickly concealed, the user simply pulls the VELCRO tie down strap 26 and the transmitter unit 10 slips freely out of the pocket 24. In seconds, the transmitter unit 10 may be removed and slipped into a pocket, sock or other concealed location on the user without drawing any further attention to itself. While a wristband carrying case 16 has been disclosed for use with the present transmitter unit 10, the transmitter unit 10 may be used without the carrying case 16, without departing from the spirit of the present invention. For example, the transmitter unit 10 may be carried in a user's pocket or clipped to a user's belt.

Should the present invention find wide dissemination in the public sector, its appearance alone, being oval shaped on the wristband carrying case 16, will have the same effect for some predators as if the victim were accompanied by a police officer. The predator would simply pass by that particular person for fear of getting caught. For the reasons presented above, the shape of the transmitter unit 10 plays an integral role in the overall mission of the present invention.

The present personal recovery system 12 is designed to provide parents, and other individuals placed in a guardian position, with an effective system for monitoring the status and location of those for which they are responsible. As such, the present personal recovery system 12 provides controlled, timed warning signals whether or not the individual wearing the transmitter unit 10 activates transmission of a warning signal. The provision of controlled, timed warning signals ensures that those incapacitated and unable to activate the transmitter are provided with the attention they require. In addition, the provision of controlled, timed warning signals ensures that children who might forget to properly use the transmitter unit 10 are also provided with the attention they require.

With this in mind, the present personal recovery system 12 includes a central processing center 34 and a user worn transmitter unit 10. Briefly, the transmitter unit 10 sends warning signals to the central processing center 34 when it is activated. As will be discussed in greater detail below, the transmitted warning signal includes information enabling the central processing center 34 to determine the status and location of the individual to whom the transmitter unit 10 is assigned.

With reference to FIGS. 1 and 3, the transmitter unit 10 houses a transmitter 36. The transmitter 36 may be a conventional signal transmitter used in the wireless transmission of signals. As such, the transmitter 36 will transmit in either burst or data stream, on either police/CB channels or a cellular network. However, other transmission protocols may be employed without departing from the spirit of the present invention. The transmitter 36 is also provided with a microprocessor 38 for performing various functions described in the following disclosure.

The transmitter unit 10 is provided with a conventional transmit button 30 in communication with the transmitter 36. The transmit button 30 is in communication with the transmitter 36 and instructs the transmitter 36 to send a warning signal. As such, an individual experiencing trouble may press the transmit button 30 and a warning signal is sent to the central processing center 34 where the proper authorities are informed of the emergency.

Unfortunately, however, individuals are not always able to press a transmit button 30 when they are in need of help. As such, the present transmitter unit 10 is provided with means ensuring the transmission of a warning signal when help is needed. The transmitter unit 10 accordingly includes a digital clock 40 associated with an automatic transmission initiating circuit 42. The automatic transmission initiating circuit 42 is preferably a programmable microprocessor, including a programmable memory 44, designed to issue a signal to the transmitter 36 at scheduled times of the day. Programming buttons 32, for example, a keyboard, on the face of the transmitter unit 10 are used to selectively program the automatic transmission initiating circuit such that scheduled signals may be varied to suit the needs of specific users. The scheduled signals may contain either standard alert messages programmed with the transmitter unit 10 or contain short messages keyed in via the transmitter unit's microprocessor 38.

The automatic transmission initiating circuit 42 is provided with a preliminary countdown signal 46 warning the user that a transmit signal, instructing the transmitter 36 to send a warning signal, will be sent to the transmitter 36 if a reset button 48 is not pressed within a predetermined period of time. The warning is by way of an audible, visible or vibratory alarm issued by the preliminary countdown signal 46. The individual is pre-advised that the alarm indicates a warning signal will be sent by the transmitter unit 10 if the reset button 48 is not pressed. The user, therefore, presses the reset button 48 if he or she hears the alarm and assistance is not necessary.

For example, where the automatic transmission initiating circuit 42 is programmed to initiate a warning signal transmission at one o'clock, the preliminary countdown signal 46 will initiate an audible, visible or vibratory alarm at one minute before one o'clock. If the reset button 48 is pressed before the clock reaches one o'clock, the automatic transmission initiating circuit 42 will not send a transmit signal to the transmitter 36. If, however, the reset button 48 is not pressed within the predetermined period of time, the automatic transmission initiating circuit 42 sends a transmit signal to the transmitter 36. Upon receipt of the transmit signal, the transmitter 36 sends a warning signal to the central processing center 34.

In an alternate embodiment, pressing the reset button 48 may activate the transmitter 36 to send a good status signal. Such a signal will provide the central processing center 34 with notification of the individual's whereabouts and an indication that everything is fine with the individual.

The provision of the automatic transmission initiating circuit 42 is designed to address two very serious problems. First, the automatic transmission initiating circuit 42 allows incapacitated individuals to receive the attention they require. For example, an elderly individual who is in serious need of help, but is not conscious, is not able to activate the transmitter unit 10 and request the help he or she seriously requires. However, an elderly individual wearing the present transmitter unit 10 will be provided with a preliminary countdown signal 46 alarm indicating that it is time to press the reset button 48 if everything is okay. If everything is in fact okay, the individual will press the reset button 48 and a good status signal will be sent. If, however, something is wrong, or the individual is incapacitated, the reset button 48 will not be pressed and a warning signal will be transmitted. When the present invention is used for this purpose, the automatic transmission initiating circuit 42 will be programmed to initiate warnings at regular intervals throughout the day.

The automatic transmission initiating circuit 42 is also especially helpful in monitoring the whereabouts of children. Specifically, a child who is expected home at three o'clock will have his or her transmitter unit 10 programmed to initiate the transmission of the warning signal at three o'clock. Accordingly, at a little before three o'clock the child will be provided with a preliminary countdown signal 46 alarm indicating that it is time to press the reset button 48 if everything is okay. If everything is in fact okay, the child will press the reset button 48 and a good status signal will be sent. If, however, something is wrong, or the individual is incapacitated, the reset button 48 will not be pressed and a warning signal will be transmitted. As discussed above, the present signaling arrangement may be varied to provide no signal when the reset button 48 is pressed.

While the present automatic transmission initiating circuit 42 employs a reset circuit allowing an individual to stop the transmission of a warning signal, the present invention could be designed without the reset button 48. Under such a design, the automatic transmission initiating circuit 42 would send a warning signal identifying the location of the individual at scheduled times throughout the day. In addition, it should be readily understood that the automatic transmission initiating circuit 42 works in conjunction with the transmission button 30 and does not override the transmission button 30. As such, an individual requiring help need not wait for the scheduled activation of the automatic transmission initiating circuit 42, and may simply press the transmission button 30 to request help.

In addition to the automatic transmission initiating circuit 42, the present transmitter unit 10 is provided with an accelerometer 50 recording rapid decelerations, for example, the jarring motion caused when an individual falls or is hit by an object. The accelerometer 50 is associated with the transmitter 36 for activating the transmitter 36 to send a warning signal to the central processing center 34 when a rapid deceleration is recorded by the accelerometer 50.

The accelerometer 50 is also associated with the reset button 48. As such, when an individual wearing the transmitter unit 10 is subject to rapid deceleration due to falling down or being struck, the accelerometer 50 initiates an audible, visible or vibratory alarm telling the individual that a transmit signal will be sent to the transmitter 36 if the reset button 48 is not pressed. If the reset button 48 is pressed within a predetermined period of time, for example, one minute, the accelerometer 50 will reset and will not send a transmit signal to the transmitter 36. If, however, the reset button 48 is not pressed within the predetermined period of time, the accelerometer 50 will send a transmit signal to the transmitter 36. Upon receipt of the transmit signal, the transmitter 36 sends a warning signal to the central processing center 34.

The accelerometer 50 achieves proper sensing of a variety of predefined acceleration/deceleration situations through the use of a single internal motion detector by providing an adjustable threshold on the front end that tunes the motion detector to respond to varying motion readings according to particular defined situation.

An alternate embodiment (see FIG. 5) of the present invention may be provided with a video unit 52 for recording the surroundings of an individual when the transmit button 30', or other specified button, is pressed. Specifically, the video unit 52 is incorporated within the transmitter unit 10' and is activated when the user points the video unit 52 at an object and presses the appropriate button (in accordance with the preferred embodiment, the transmit button 30' is pressed to simultaneously transmit a warning signal and a video image). When this occurs, the recorded image is sent along with a warning signal to the central processing center 34.

In accordance with the preferred embodiment of the present invention, the recorded image is sent via asynchronous transfer mode (ATM) over a cellular network to the central processing center, and this embodiment is, therefore, provided with an ATM processor 54 in communication with the video unit 52 and the transmitter 36'. The video image provides authorities with an instantaneous picture of the abductor or assailant. The video image transmitted to the central processing center may then be used by authorities in providing necessary assistance to the individual using the transmitter. The video unit 52 may also be a deterrent once such units are commonly in use. Specifically, an assailant confronted with a video unit will understand that a video image has been sent to the authorities and will hopefully think better of continuing with any illegal intentions he or she may have in mind.

In accordance with an alternate embodiment of the digital video/snap shot feature described above, activation of the video unit 52 may be remotely controlled by the central processing center 34 (discussed below in substantial detail). In addition, the video unit 52 may be activated by any other automatic initiating processes available through the transmitter unit 10'. For instance, by setting the preferences of the transmitter unit 10' accordingly, a digital photo/video may be initiated in concert with the transmission of a warning signal by the transmitter unit 10' based upon time of day, motion detection, safe zone or remote trigger. In such instances, the initiated alert would include the user ID, user's location as determined by the transmitter unit's internal GPS receiver 56', the alert status and the digital phot/video of the surroundings. In accordance with the basic embodiment of the transmitter unit 10', this alert would then be transmitted using ATM or other appropriate protocols to the central processing center 34 via wireless transmission means, for example, but not limited to, cellular phone infrastructure.

While the embodiments discussed above disclose warning signals and good status signals, the present personal recovery system could 12 be adapted to provide a wide variety of warning signals. For example, the transmitter unit 10 may be programmed to provide a warning signal indicating that emergency medical assistance is needed or that emergency police assistance is necessary.

Figure 4:
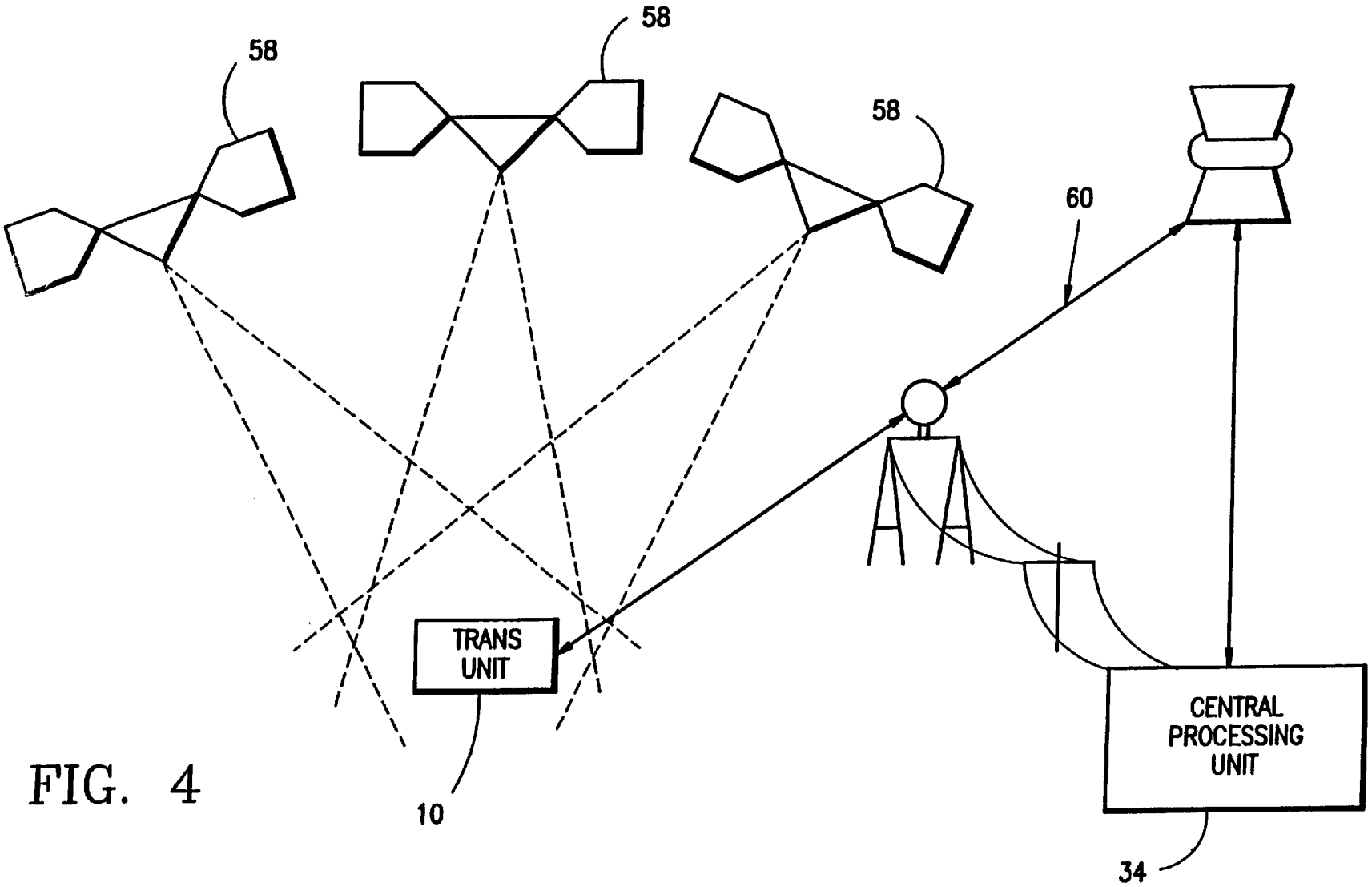
FIG. 4 is a schematic of the transmission process used in the present personal recovery system.

With reference to FIGS. 1, 3 and 4, the signal transmission arrangement is disclosed. When a user presses the transmit button 30 or an automatic transmission is activated, the transmitter unit's Global Positioning System (GPS) receiver 56 first acquires four to five of the GPS satellite's 58 transmissions (this takes 1 to 2 seconds). At any given time, there are a minimum of five GPS satellites 58 in view of virtually any place on earth. They transmit constantly without the need to respond to any commands from a transmitter unit 10. The accuracy of the GPS is the heart of the timeliness and accuracy of the present invention in getting help on the way to victims/users in literally 1–2 minutes.

Once the GPS information is obtained, the microprocessor 38 of the transmitter 36 calculates the latitude and longitude of the transmitter unit 10, and the microprocessor 38 adds this location information to the warning signal set to be transmitted. The warning signal is transmitted over a cellular network 60, or other mobile communication means, to the central processing center 34. The central processing center 34 then utilizes the warning signal information in the manner to locate the missing person or send necessary emergency staff to the individual initiating the warning signal.

The central processing center 34 may be incorporated in a police station or the center may be maintained as a private enterprise working in conjunction with emergency facilities. It is also envisioned that the central processing center 34 may be a home unit controlled from the home of an individual using the present personal recovery system.

Regardless of the specific location of the central processing center 34, the center works in substantially the same manner and various charges may be made without departing from the spirit of the present invention.

Whether the central processing center 34 is privately or publicly maintained, each transmitter unit will be registered with the central processing center 34. Registration information should include the geographic home of the transmitter units registered user, the contact person in the event a warning signal is received, an optional digital photo of the user, any special medical information, such as medication or allergy alerts, or any other information specific to the user's use of the transmitter unit.

As discussed above, the central processing center 34 is the hub for the information flow and follow-up processing on each transmitted warning signal. Each transmission is transmitted through the cellular network or on a police/CB band to the central processing center 34. When the warning signal is received at the central processing center 34 an operator is immediately alerted. The operator selects the alert and the central processing center 34 computer accesses from its digital database the proper regional map associated with the alert and displays the map and the location of the transmitter unit. Along with other pertinent data, the display includes the latitude and longitude of the transmitter unit, the status message, the nearest emergency assistance in that region, and the personal emergency contact phone number supplied by the user. The system will also provide other pertinent data in the file, such as, an optional digital photo of the user, any special medical information, for example, medication or allergy alerts, or any other information specific to the user's use of the transmitter unit.

Once appropriate information is accessed from the computer, appropriate action is taken. In the event of an emergency or an emergency requiring medical attention, a call or exchange of data is initiated with the appropriate regional emergency center and a call is issued to the emergency contact listed for the user. The data exchange with the emergency station might even include a fax of the photo listed for the user which could assist in finding missing persons.

In the event of routine transmissions, the concerned person is periodically updated on the location of the transmitter unit's user for various purposes. Another method for locating an individual would be to call the computer processing center 34 and request that they trigger the transmitter unit from the central processing center 34 for location updates. It should also be understood that the transmitter will continually and regularly (for example, every 5–10 minutes) send warning signals after the transmitter is first activated to send a warning signal. Specifically, the transmitter unit, once activated in any emergency situation by pressing the transmit button or by automatic activation, will continue to retransmit a warning signal. In this way, individuals are continually updated as to the user's location until either the proper input is entered to cease the transmission of warning signals or the battery of the transmitter unit dies.

It is contemplated that a user may access the transmitter unit he/she desires, via the Internet and to allow the user to enter a command page specifically for their own account(s). From this command page, the user could act in the same manner as a Central Processing Center (CPC) operator. Thus the user would be able to toggle the unit for its location, having that information displayed on their computer screen. In addition, they could track it, communicate with it, command it into various modes/functions remotely, and then command it to take pictures/videos, set safe zone parameters, display data histories from. various functions and cause it to perform other functions pertinent to the "on-line" user's needs. Essentially, the on-line user would have all of the capabilities of the CPC operator.

Figure 5:
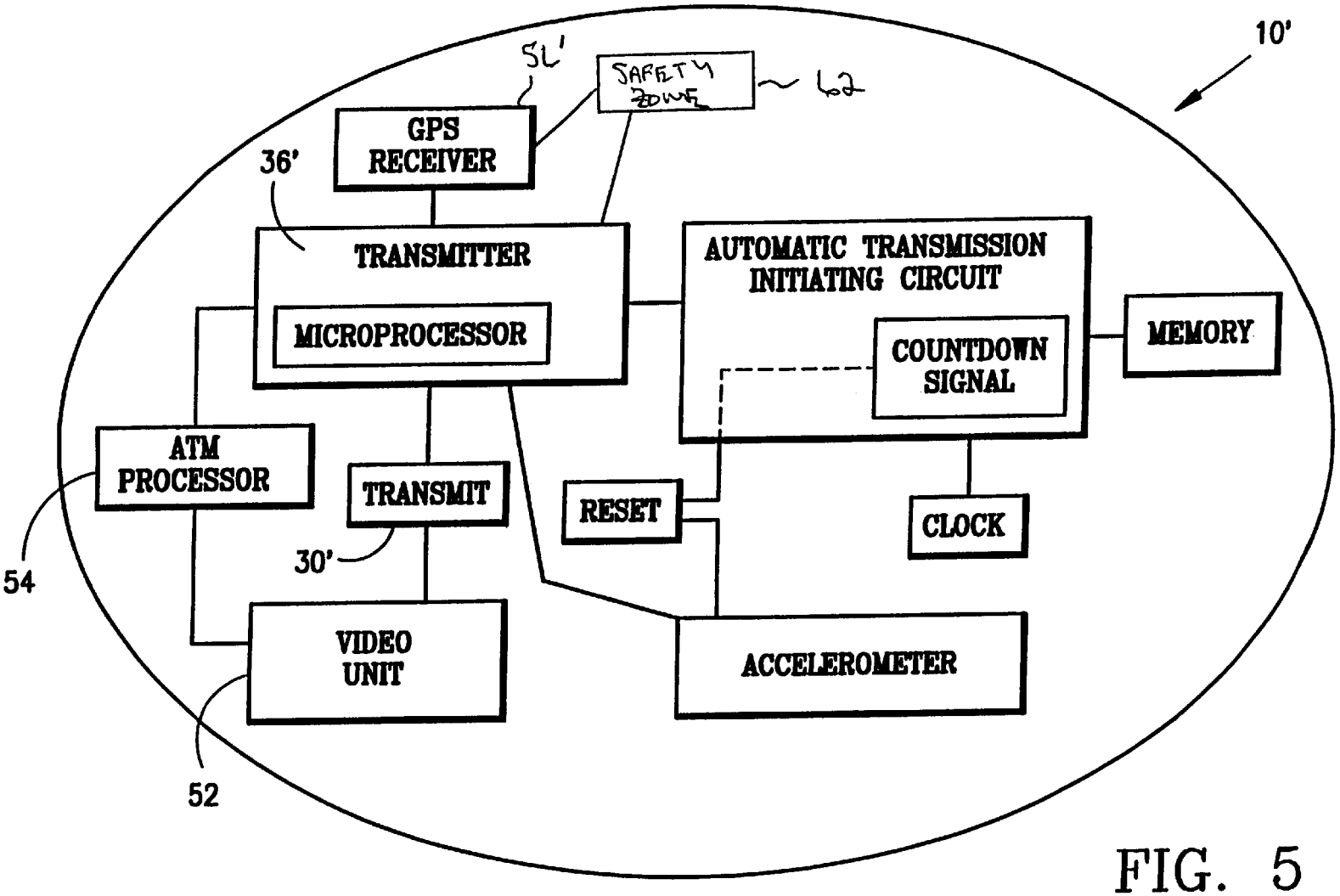
FIG. 5 is a schematic of an alternate embodiment of the transmitter unit employing a video unit.

With reference to FIG. 5, a further feature of the present invention is disclosed. Specifically, the present personal recovery system includes a safety zone feature 62 allowing the transmitter unit 10' or the central processing center 34 to define a radius or circumference around the user based upon predefined criteria established via the use of a calculated GPS position. The radius/circumference is then stored in the memory of the transmitter unit 10'. By periodically rechecking its position, the transmitter unit 10' is able to monitor its position relative to the predefined safe zone. If the update location falls outside of the defined circle, the transmitter unit 10' will automatically initiate an alarm to the central processing center 34', or other appropriate site stating that the transmitter unit 10' has moved from the predefined safe zone.

In accordance with a preferred embodiment of the present invention, the safe zone is defined by a horizontal plane, for example, in the case of a user on the ground. The safe zone may also be defined with a vertical element to thereby define an altitude within which transmitter is maintained. This provides the user with the ability to describe not only a safe latitude/longitude, but an altitude as well.

It is contemplated that the inclusion of altitude within the safe zone is important for aircraft safety. Specifically, the impact of a crash often renders most search beacons useless. With the present transmitter unit 10' in the safe zone mode, the alert could go out prior to impact when the transmitter unit 10 passes a vertical safe zone line and the pilot likely will have other things on his or her mind. The transmitter unit 10 may, therefore, be tied into the flight computer to give snapshot or frame sequence at given intervals to allow for immediate summation of the situation by the appropriate officials in time of the emergency.

It is contemplated that the use of the safe zone in accordance with the present invention will function in the following manner. The user would first select the proper function of the transmitter unit 10' for the safe zone operation to be activity. The user would then enter the desired radius via the programming buttons 32 and press select. The transmitter unit 10' then calculates it current GPS derived location and calculates the corresponding safe zone or circumference around the location. It is further contemplated that the safe zone may also be downloaded from the central processing center 34 or appropriate station into the transmitter unit 10' and then place the unit 10' in the desired corresponding function. Whether the safe zone is input by the user or via the central processing center, the remainder of the scenario proceeds as follows.

The transmitter unit 10' then periodically re-checks its location via the GPS receiver 56' to ensure that it remains within the safe zone. If the transmitter unit 10' determines that it has moved outside of the safe zone, it then sends an alert to the central processing center 34 for follow-up action. The initiated alert then would include the user ID, user's location/altitude as determined by the transmitter unit's internal GPS receiver 56, the alert status, possible digital phot/video of the surroundings or data snapshots. In accordance with the basic embodiment of the transmitter unit 10, this alert would then be transmitted using ATM or other appropriate protocols to the central processing center 34 or other appropriate station via a wireless transmission means, nominally via cellular phone infrastructure or radio frequency, but not limited to just that.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A user carried recovery unit, comprising:

a transmitter unit carried by a user, the transmitter unit including a transmitter case housing functional electrical components of the transmitter unit;

the transmitter unit includes a transmitter for selectively transmitting a warning signal to a central processing center and a motion detector recording rapid deceleration, wherein the motion detector is associated with the transmitter for activating the transmitter to send a warning signal to the central processing center for immediate emergency action when a rapid deceleration is recorded by the motion detector;

further including means for resetting associated with the transmitter for preventing the transmission of a warning signal in the event the impending transmission of a warning signal is undesired.

2. The personal recovery unit according to claim 1, wherein the means for resetting including an alarm activated when the accelerometer records a rapid deceleration, and the means for resetting signals the transmitter to cease transmission of a warning signal when an individual presses a reset button within a predetermined time in response to the alarm and the transmitter sends the warning signal to the central processing center when the individual does not press the reset button within a predetermined time.

3. The personal recovery unit according to claim 1, wherein the transmitter unit includes a clock and means for initiating the transmission of a warning signal at a specified time of day such that the location of an individual is provided at a specified time of day, and the means for initiating includes a manual input integrally formed with the transmitter unit for selectively setting the specified time of day at which the transmitter unit is to transmit a warning signal.

4. The personal recovery unit according to claim 1, wherein warning signals are regularly transmitted after the transmission of warning signals is initiated.

5. The personal recovery unit according to claim 1, wherein the transmitter unit further includes a video unit for recording an image of the area surrounding the individual carrying the personal recovery unit, wherein the video unit is associated with the transmitter such that the recorded image is sent with the warning signal to the central processing center.

6. The personal recovery unit according to claim 1, wherein the transmitter unit further includes means for defining a safe zone; and the transmitter selectively transmits a warning signal to the central processing center when the transmitter unit is moved beyond the safe zone.

7. A user carried personal recovery unit, comprising:

a transmitter unit carried by a user, the transmitter unit including a transmitter case housing functional electrical components of the transmitter unit;

the transmitter unit includes a transmitter for selectively transmitting a warning signal including information regarding the status and the location of the user to a central processing center and a video unit for recording an image of the area surrounding the individual carrying the personal recovery unit, wherein the video unit is associated with the transmitter such that the recorded image is sent with the warning signal to the central processing center.

8. The personal recovery unit according to claim 7, wherein the recorded image is sent via asynchronous transfer mode.

9. The personal recovery unit according to claim 8, wherein the recorded image is sent over a cellular network to the central processing center.

10. The personal recovery unit according to claim 7, wherein the transmitter unit includes a clock and means for initiating the transmission of a warning signal at a specified time of day such that the location of an individual is provided at a specified time of day, and the means for initiating includes a manual input integrally formed with the transmitter unit for selectively setting the specified time of day at which the transmitter unit is to transmit a warning signal.

11. The personal recovery unit according to claim 7, wherein warning signals are regularly transmitted after the transmission of warning signals is initiated.

12. The personal recovery unit according to claim 7, wherein the transmitter unit further includes means for defining a safe zone; and the transmitter selectively transmits a warning signal to the central processing center when the transmitter unit is moved beyond the safe zone.

13. A user carried personal recovery unit, comprising:

a transmitter unit carried by a user, the transmitter unit including a transmitter case housing functional electrical components of the transmitter unit;

the transmitter unit further including means for defining a safe zone housed within the transmitter case and a transmitter activated to transmit a warning signal to a central processing center when the transmitter unit is moved beyond the safe zone; and wherein the transmitter unit includes means for regularly rechecking its position relative to the predefined safe zone and determining whether the transmitter unit is still within the safe zone, and in the event the transmitter unit determines that it is beyond the safe zone the transmitter unit instructs the transmitter contained therein to issue a warning signal to the central processing center.

14. The personal recovery unit according to claim 13, wherein the safe zone includes a horizontal element.

15. The personal recovery unit according to claim 14, wherein the safe zone includes a vertical element.

16. The personal recovery unit according to claim 13, wherein the safe zone includes a vertical element.

17. The personal recovery unit according to claim 13, wherein the safe zone is programmed via programming buttons on the transmitter unit.

18. The personal recovery unit according to claim 13, wherein the safe zone is programmed remoted from the central processing center.

19. The personal recovery unit according to claim 1, wherein the motion detector is an accelerometer.

* * * * *

Disclaimer 6,377,179—John G. Fulton, 9921 Gordon Rd., Spotsylvania, VA (US) 22553. PERSONAL RECOVERY SYSTEM, Patent dated Apr. 23, 2002. Disclaimer filed Jun. 20, 2009, by inventor.

Hereby enters this disclaimer to claims 1, 2, 4, 5, 11 and 19 of said patent.

(*Official Gazette, March 2, 2010*)

Disclaimer

6,377,179 B1—John G. Fulton, Spotsylvania, VA (US). PERSONAL RECOVERY SYSTEM. Patent dated April 23, 2002. Disclaimer filed June 20, 2009, by the inventor.

Hereby enters this disclaimer to claims 1, 2, 4, 5, 7-9, 11 and 19 of said patent.

(*Official Gazette, June 15, 2010*)

US006377179C1

(12) INTER PARTES REEXAMINATION CERTIFICATE (0211th)

United States Patent

Fulton

(10) Number: US 6,377,179 C1

(45) Certificate Issued: Nov. 30, 2010

(54) PERSONAL RECOVERY SYSTEM

(76) Inventor: John G. Fulton, 9921 Gordon Rd., Spotsylvania, VA (US) 22553

Reexamination Request:
No. 95/000,129, Feb. 10, 2006

Reexamination Certificate for:

| | |
|---|---|
| Patent No.: | **6,377,179** |
| Issued: | **Apr. 23, 2002** |
| Appl. No.: | **09/639,939** |
| Filed: | **Aug. 17, 2000** |

Disclaimer of Claims 1, 2, 4, 5, 11 and 19 Filed Jun. 26, 2009 (O.G. Mar. 2, 2010). Disclaimer of Claims 1, 2, 4, 5, 7, 8, 9, 11 and 19 Filed Jun. 12, 2006 (O.G. Jun. 15, 2010).

(51) Int. Cl.

| | |
|---|---|
| ***G08B 21/02*** | (2006.01) |
| ***G08B 21/00*** | (2006.01) |
| ***G08B 25/01*** | (2006.01) |

(52) U.S. Cl. ..... 340/573.1; 340/539.1; 340/539.11; 340/574; 340/825.49; 340/990; 348/135; 348/143; 348/158

(58) Field of Classification Search ..... None
See application file for complete search history.

(56) References Cited

U.S. PATENT DOCUMENTS

| | | | | | |
|---|---|---|---|---|---|
| 2,475,578 | A | * | 7/1949 | Halstead | 455/79 |
| 5,392,052 | A | | 2/1995 | Eberwine | |
| 5,497,149 | A | * | 3/1996 | Fast | 340/988 |
| 5,650,770 | A | * | 7/1997 | Schlager et al. | 340/573.1 |
| 5,712,679 | A | | 1/1998 | Coles | |
| 5,822,321 | A | | 10/1998 | Petersen et al. | |
| 5,835,907 | A | | 11/1998 | Newman | |
| 5,940,004 | A | | 8/1999 | Fulton | |
| 6,028,514 | A | * | 2/2000 | Lemelson et al. | 340/539.13 |
| 6,057,759 | A | * | 5/2000 | Marsh | 340/539.11 |
| 6,072,396 | A | * | 6/2000 | Gaukel | 340/573.4 |
| 6,133,853 | A | | 10/2000 | Obradovich et al. | |
| 6,263,280 | B1 | * | 7/2001 | Stingone, Jr. | 701/213 |
| 6,469,735 | B2 | | 10/2002 | Coles | |
| 6,768,724 | B1 | * | 7/2004 | Olkkonen | 370/310.1 |

FOREIGN PATENT DOCUMENTS

EP 0 869 464 A1 10/1998

OTHER PUBLICATIONS

Xybernaut Corp., *The Mobile Assistant® Series of wearable computers: Applications using Hands–Free, Speech–Activated Wearable Computing,* as of Apr. 27, 1999, archived at http://web.archive.org/web/19990427125842/www.xybernaut.com/products/2products_apps.1.html.

Mobile Assistant® IV (MA IV™) Technical Specifications, as of May 1, 1999, archived at http://web.archive.org/web/19990501181807/www.kanakaris.com/xybernaut/MAIVspecifications.html.

Steve Ditlea, "Cyborg for a Day: Take a walk with the new wearable computer and see the future," *Popular Mechanics,* Sep. 1, 1999 (viewable at http://www.popularmechanics.com/technology/. computers/1278501.html?page=&c=y).

Rebecca Sykes, "Xybernaut now has Linux for wearable PCs," CNN.COM, Dec. 16, 1999, archived at http://archives.cnn.com/1999/TECH/computing/12/16/wearable.linux.idg/index.html.

* cited by examiner

*Primary Examiner*—Alexander J Kosowski

(57) ABSTRACT

A personal recovery unit including a transmitter unit carried by a user is disclosed. The transmitter unit includes an accelerometer, safe zone and/or a video unit used to providing desired warning signals.

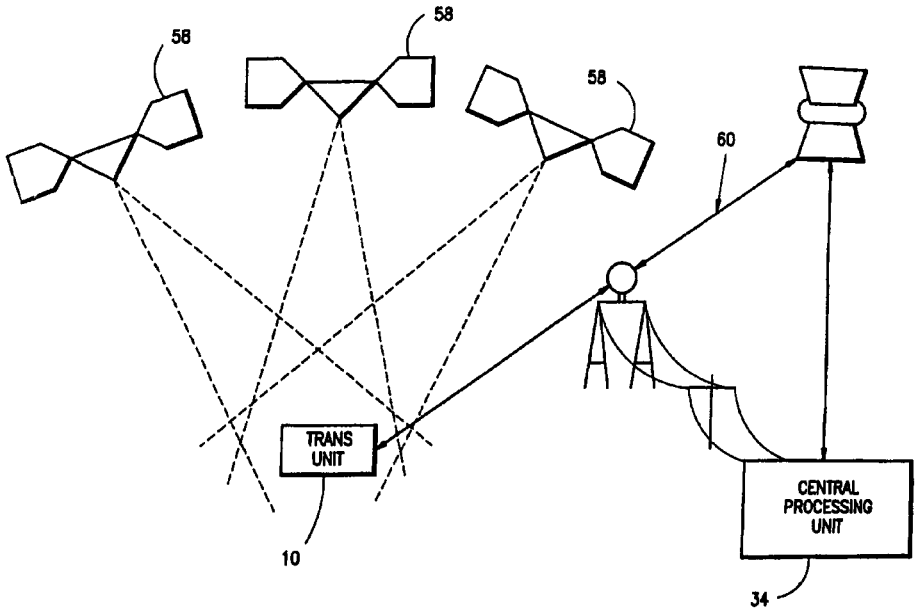

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1, 2, 4, 5, 7-9, 11 and 19 are now disclaimed.

Claims 3, 6, 10 and 12-18 are cancelled.

* * * * *